US011219786B2

(12) United States Patent
Lee

(10) Patent No.: US 11,219,786 B2
(45) Date of Patent: Jan. 11, 2022

(54) INNER SHELL AND MASK INCLUDING SAME

(71) Applicant: 3M INNOVATIVE PROPERTIES COMPANY, St. Paul, MN (US)

(72) Inventor: Jin-Ho Lee, Seoul (KR)

(73) Assignee: 3M Innovative Properties Company, St. Paul, MN (US)

( * ) Notice: Subject to any disclaimer, the term of this patent is extended or adjusted under 35 U.S.C. 154(b) by 201 days.

(21) Appl. No.: 16/187,003

(22) Filed: Nov. 12, 2018

(65) Prior Publication Data

US 2019/0143152 A1 May 16, 2019

(30) Foreign Application Priority Data

Nov. 13, 2017 (KR) ..... 10-2017-0150818

(51) Int. Cl.

| | |
|---|---|
| ***A62B 18/08*** | (2006.01) |
| ***A62B 18/02*** | (2006.01) |
| ***A62B 7/10*** | (2006.01) |
| ***A62B 23/02*** | (2006.01) |
| ***A62B 18/10*** | (2006.01) |

(52) U.S. Cl.

CPC ..... *A62B 18/08* (2013.01); *A62B 7/10* (2013.01); *A62B 18/025* (2013.01); *A62B 18/10* (2013.01); *A62B 23/025* (2013.01)

(58) Field of Classification Search

CPC ..... A62B 7/00; A62B 7/10; A62B 18/00–10; A62B 23/00–06; A41D 13/11–1192; A61B 5/0062–0066; A61B 5/1077–1079; B33Y 80/00; A61M 2207/00–10; A61M 16/06–0655; A61M 2016/0661

See application file for complete search history.

(56) References Cited

U.S. PATENT DOCUMENTS

| | | | | |
|---|---|---|---|---|
| 3,888,246 A | | 6/1975 | Lauer | |
| 4,384,577 A | * | 5/1983 | Huber | A41D 13/1146 128/206.19 |
| 4,454,881 A | * | 6/1984 | Huber | A41D 13/1146 128/206.15 |
| 4,641,645 A | | 2/1987 | Tayebi | |
| 4,856,508 A | | 8/1989 | Tayebi | |
| 4,873,972 A | * | 10/1989 | Magidson | A62B 18/025 128/206.12 |
| 5,094,236 A | | 3/1992 | Tayebi | |
| 5,706,803 A | | 1/1998 | Bayer | |
| 7,086,400 B2 | | 8/2006 | Shigematsu | |

(Continued)

FOREIGN PATENT DOCUMENTS

| | | |
|---|---|---|
| CA | 2068925 | 11/1992 |
| CA | 2399959 | 6/1996 |

(Continued)

*Primary Examiner* — Elliot S Ruddie

(57) ABSTRACT

An inner shell according to an embodiment of the present disclosure, which is provided to maintain a shape of a mask, includes a circumferential part forming an edge, a curved part formed in an arch shape at an inner side of the circumferential part, and a plurality of ribs formed to radially protrude from a peak area of the curved part toward the circumferential part, wherein the circumferential part, the curved part, and the ribs are integrally formed as a sheet member formed of a porous material.

20 Claims, 9 Drawing Sheets

(56) References Cited

U.S. PATENT DOCUMENTS

| | | | | |
|---|---|---|---|---|
| 2002/0056450 | A1 | 5/2002 | Lee | |
| 2006/0005838 | A1* | 1/2006 | Magidson | A41D 13/1176 128/206.19 |
| 2006/0174890 | A1 | 8/2006 | Cheng | |
| 2006/0230485 | A1 | 10/2006 | Lee | |
| 2008/0023006 | A1 | 1/2008 | Kalatoor | |
| 2008/0099022 | A1 | 5/2008 | Gebrewold | |
| 2011/0061657 | A1 | 3/2011 | Matich | |
| 2012/0017911 | A1 | 1/2012 | Choi | |
| 2012/0097167 | A1 | 4/2012 | Ono | |
| 2012/0125341 | A1 | 5/2012 | Gebrewold | |
| 2012/0180795 | A1 | 7/2012 | Knight | |
| 2013/0139823 | A1 | 6/2013 | Lee | |
| 2014/0216479 | A1 | 8/2014 | Jeong | |
| 2014/0326255 | A1 | 11/2014 | Teng | |
| 2015/0040910 | A1 | 2/2015 | Koehler | |
| 2015/0059773 | A1 | 3/2015 | Duffy | |
| 2017/0157436 | A1* | 6/2017 | Hosmer | A62B 18/084 |

FOREIGN PATENT DOCUMENTS

| | | | |
|---|---|---|---|
| CA | 2191541 | 5/1997 | |
| CN | 2049532 | 12/1989 | |
| CN | 2067171 | 12/1990 | |
| CN | 1100662 | 3/1995 | |
| CN | 2401206 | 10/2000 | |
| CN | 2657710 | 11/2004 | |
| CN | 2843530 | 12/2006 | |
| CN | 201052348 | 4/2008 | |
| CN | 201341455 | 11/2009 | |
| CN | 201410241 | 2/2010 | |
| CN | 101683188 | 3/2010 | |
| CN | 201536662 | 8/2010 | |
| CN | 101816466 | 9/2010 | |
| CN | 201612180 | 10/2010 | |
| CN | 201668891 | 12/2010 | |
| CN | 201805966 | 4/2011 | |
| CN | 201995629 | 5/2011 | |
| CN | 201854700 | 6/2011 | |
| CN | 201550643 | 8/2011 | |
| CN | 202050969 | 11/2011 | |
| CN | 102440458 | 5/2012 | |
| CN | 202218622 | 5/2012 | |
| CN | 202233134 | 5/2012 | |
| CN | 202276859 | 6/2012 | |
| CN | 202286410 | 7/2012 | |
| CN | 202425641 | 9/2012 | |
| CN | 202476506 | 10/2012 | |
| CN | 202504227 | 10/2012 | |
| CN | 202618365 | 12/2012 | |
| CN | 202697798 | 1/2013 | |
| CN | 202722579 | 2/2013 | |
| CN | 102948934 | 3/2013 | |
| CN | 202819725 | 3/2013 | |
| CN | 202999375 | 6/2013 | |
| CN | 203015896 | 6/2013 | |
| CN | 103263093 | 8/2013 | |
| CN | 203105696 | 8/2013 | |
| CN | 203164546 | 8/2013 | |
| CN | 203262322 | 11/2013 | |
| CN | 203262327 | 11/2013 | |
| CN | 203523849 | 4/2014 | |
| CN | 203555199 | 4/2014 | |
| CN | 203634676 | 6/2014 | |
| CN | 203736731 | 7/2014 | |
| CN | 104000319 | 8/2014 | |
| CN | 203814638 | 9/2014 | |
| CN | 203828131 | 9/2014 | |
| CN | 203852758 | 10/2014 | |
| CN | 104172590 | 12/2014 | |
| CN | 204015181 | 12/2014 | |
| CN | 204048143 | 12/2014 | |
| CN | 104305591 | 1/2015 | |
| CN | 104305592 | 1/2015 | |
| CN | 204091057 | 1/2015 | |
| CN | 204191648 | 3/2015 | |
| CN | 204233634 | 4/2015 | |
| CN | 204259883 | 4/2015 | |
| CN | 204259885 | 4/2015 | |
| CN | 204393423 | 6/2015 | |
| CN | 204409656 | 6/2015 | |
| CN | 204635137 | 9/2015 | |
| CN | 204697935 | 10/2015 | |
| CN | 105054397 | 11/2015 | |
| CN | 105077762 | 11/2015 | |
| CN | 204888801 | 12/2015 | |
| CN | 204888802 | 12/2015 | |
| CN | 204908034 | 12/2015 | |
| CN | 204930458 | 1/2016 | |
| CN | 105495777 | 4/2016 | |
| CN | 205456236 | 8/2016 | |
| CN | 205456247 | 8/2016 | |
| CN | 205512492 | 8/2016 | |
| CN | 106037090 | 10/2016 | |
| CN | 205611844 | 10/2016 | |
| CN | 106072917 | 11/2016 | |
| CN | 106108178 | 11/2016 | |
| CN | 205671530 | 11/2016 | |
| CN | 205757362 | 12/2016 | |
| CN | 106343634 | 1/2017 | |
| CN | 205848760 | 1/2017 | |
| CN | 205866064 | 1/2017 | |
| CN | 205912927 | 2/2017 | |
| CN | 205947188 | 2/2017 | |
| CN | 106490724 | 3/2017 | |
| CN | 206025295 | 3/2017 | |
| CN | 106562493 | 4/2017 | |
| CN | 106579598 | 4/2017 | |
| CN | 206079118 | 4/2017 | |
| CN | 206101707 | 4/2017 | |
| CN | 106617389 | 5/2017 | |
| CN | 106617393 | 5/2017 | |
| CN | 106617396 | 5/2017 | |
| CN | 106723506 | 5/2017 | |
| CN | 106723508 | 5/2017 | |
| CN | 106723517 | 5/2017 | |
| CN | 106723522 | 5/2017 | |
| CN | 206150521 | 5/2017 | |
| CN | 206197131 | 5/2017 | |
| CN | 206197133 | 5/2017 | |
| CN | 106858821 | 6/2017 | |
| DE | 2335160 | 1/1975 | |
| EP | 0081943 | 6/1983 | |
| EP | 1214896 | 6/2002 | |
| EP | 1614361 | 1/2006 | |
| EP | 2589413 | 5/2013 | |
| GB | 1182838 A * | 3/1970 | A41D 13/1146 |
| JP | 07328135 | 12/1995 | |
| JP | 09239050 | 9/1997 | |
| JP | 10165526 | 6/1998 | |
| JP | 2008049194 | 3/2008 | |
| JP | 2008148984 | 7/2008 | |
| JP | 2009226183 | 10/2009 | |
| JP | 3158500 | 4/2010 | |
| JP | 2010240083 | 10/2010 | |
| JP | 3192589 | 7/2014 | |
| JP | 6103412 | 3/2017 | |
| JP | 3210430 | 5/2017 | |
| KR | 200424352 | 8/2006 | |
| KR | 20080006685 | 12/2008 | |
| KR | 20090014662 | 2/2009 | |
| KR | 20110008148 | 1/2011 | |
| KR | 20110124937 | 11/2011 | |
| KR | 20120077716 | 7/2012 | |
| KR | 200474665 | 10/2014 | |
| KR | 101532558 | 6/2015 | |
| KR | 20160061036 | 5/2016 | |
| TW | M495862 | 2/2015 | |
| WO | WO 1997-10027 | 3/1997 | |
| WO | WO 1999-55179 | 11/1999 | |
| WO | WO 2004-091726 | 10/2004 | |
| WO | WO 2007-024865 | 3/2007 | |
| WO | WO 2008-143462 | 11/2008 | |

(56) References Cited

FOREIGN PATENT DOCUMENTS

| | | |
|---|---|---|
| WO | WO 2011-140542 | 11/2011 |
| WO | WO 2011-163002 | 12/2011 |
| WO | WO 2012-070805 | 5/2012 |
| WO | WO 2012-089963 | 7/2012 |
| WO | WO 2013-085898 | 6/2013 |
| WO | WO 2014-192413 | 12/2014 |
| WO | WO 2015-172315 | 11/2015 |

* cited by examiner

INNER SHELL AND MASK INCLUDING SAME

TECHNICAL FIELD

The present disclosure relates to an inner shell and mask including the same.

BACKGROUND

Masks, which are used to prevent introduction of impurities or contaminants into respiratory pathways of users, may be classified into masks including a separate filter part and filter face masks in which a mask main body itself functions as a filter.

In this case, generally, the filter face masks may be classified into masks having two different structures, that is, a fold-flat mask and a shaped mask. The fold-flat mask has a structure in which the mask is stored in a flat state but is unfolded in a cup shape upon use, and the shaped mask has a structure in which the mask has a face-fitting configuration such that the mask is manufactured in a predetermined shape, e.g., a cup shape, and maintains such a shape during storage and use.

The shaped mask may include a separate support structure to maintain its shape and may be manufactured by a sheet member, which functions as a filter, being laminated on an outer surface of the support structure.

Meanwhile, regarding the shaped mask, since maintaining the shape of the mask corresponds to an important factor in performance of the mask, research has been carried out on a structure capable of restoring a shaped mask to its original shape in a case in which the shaped mask has been deformed due to an external force applied thereto.

SUMMARY

It is an object of the present disclosure to provide an inner shell and mask including the same capable of being easily restored to its original shape even when an external force is applied thereto.

An inner shell according to an embodiment of the present disclosure, which is provided to maintain a shape of a mask, includes a circumferential part forming an edge, a curved part formed in an arch shape at an inner side of the circumferential part, and a plurality of ribs formed to radially protrude from a peak area of the curved part toward the circumferential part, wherein the circumferential part, the curved part, and the ribs can be integrally formed as a sheet member formed of a porous material.

A mask according to another embodiment of the present disclosure also can include an inner shell according to an embodiment of the present disclosure, and a filter structure coupled to an outer surface of the inner shell.

The inner shell and mask including the same according to an embodiment of the present disclosure can be easily restored to its original shape even when an external force is applied thereto.

DETAILED DESCRIPTION

Hereinafter, specific embodiments for implementing the idea of the present disclosure will be described in detail with reference to the accompanying drawings. In this case, note that the drawings are not drawn to scale for convenience of description. In addition, in describing the present disclosure, when detailed description of a related known configuration or function is deemed as having the possibility of blurring the gist of the present disclosure, the detailed description thereof will be omitted.

Figure 1:
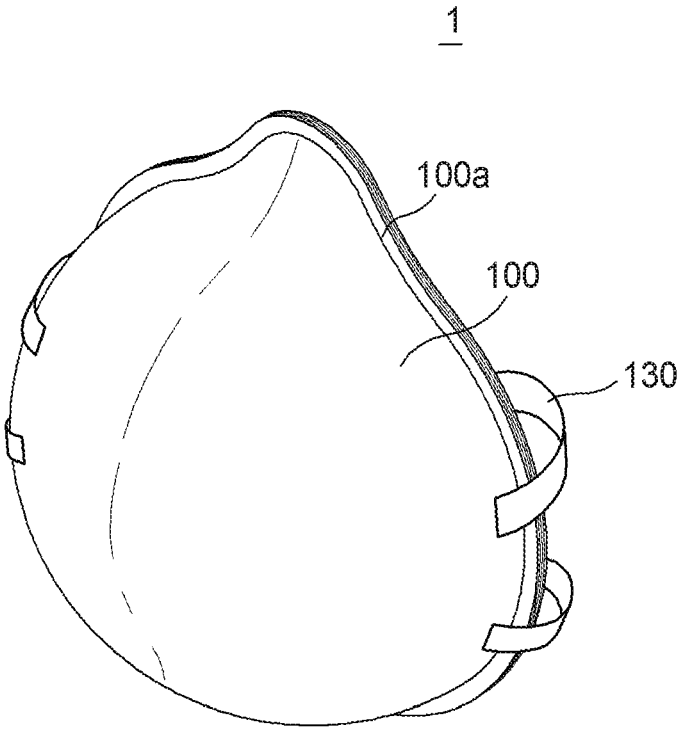
FIG. 1 is a perspective view of a mask according to an embodiment of the present disclosure.
Figure 2:
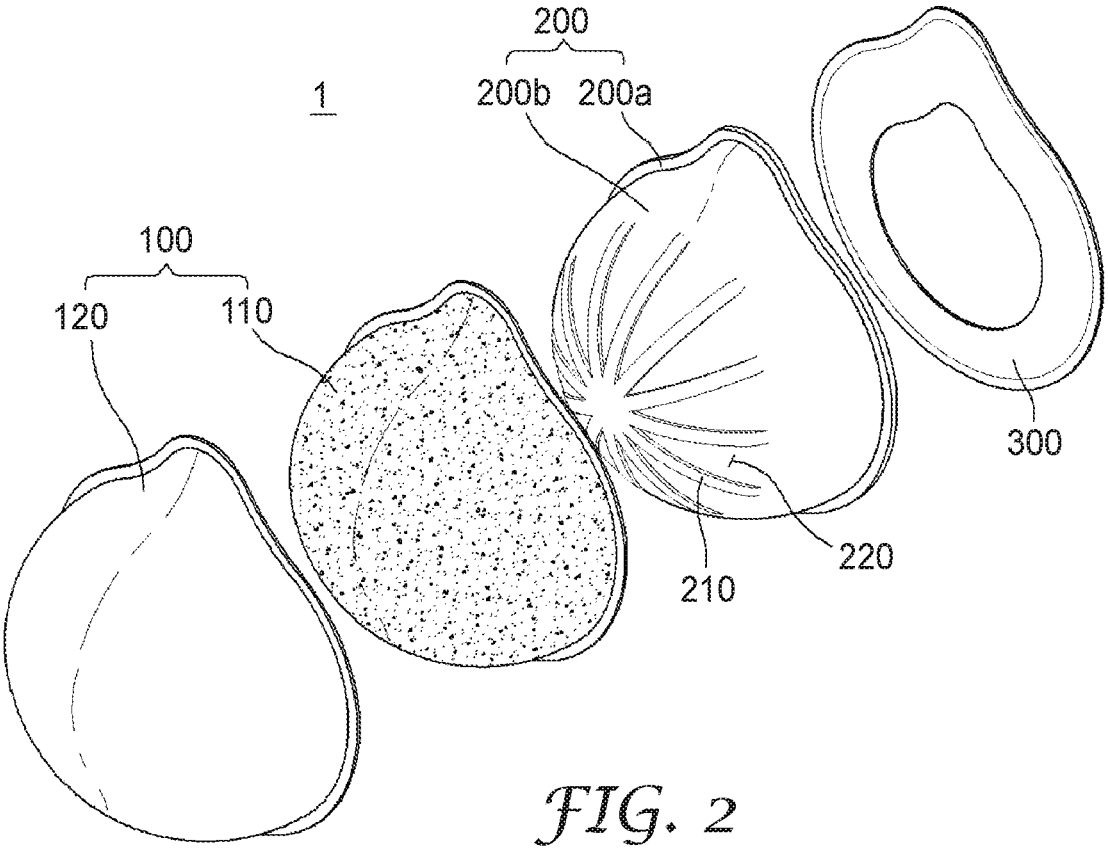
FIG. 2 is an exploded perspective view of the mask according to the embodiment of the present disclosure.

FIG. 1 is a perspective view of a mask according to an embodiment of the present disclosure, and FIG. 2 is an exploded perspective view of the mask according to the embodiment of the present disclosure.

Referring to FIGS. 1 and 2, a mask 1 according to the embodiment of the present disclosure may be provided as a shaped mask that is manufactured in a predetermined shape and is capable of maintaining the shape during storage and use. For example, the mask 1 may have an outer surface formed in an arch shape and may be manufactured to have a cup shape as a whole.

The mask 1 may include an inner shell 200 provided to maintain the shape of the mask 1 and a filter structure 100 coupled to an outer surface of the inner shell 200 and configured to perform an air filtering function.

The filter structure 100, which is provided to remove impurities from air passing through the filter structure 100 and filter the air, may form an outer surface of the mask 1, and a circumferential part 100*a* of the filter structure 100 may be coupled to a circumferential part 200*a* of the inner shell 200 which will be described below. At this time, the circumferential part of the filter structure 100 and the circumferential part 200*a* of the inner shell 200 may be coupled using various coupling methods, e.g., a heat welding or ultrasonic welding method.

The filter structure 100 may be manufactured in a multilayer shape in which a plurality of sheets are laminated. For example, the filter structure 100 may include a filter layer 110 provided for filtering air and a cover web 120 coupled to an outer surface of the filter layer 110 and configured to protect the filter layer 110 and prevent the filter layer 110 from being spaced apart from the inner shell 200. In the present embodiment, only the configuration in which the cover web 120 is only disposed at the outer surface of the filter layer 110 is illustrated. However, the cover web 120 may also be disposed at both an inner surface and the outer surface of the filter layer 110, and the cover web 120 may also be omitted in some cases.

The filter layer 110 may be provided as a filter formed of a fiber material that is capable of achieving typically demanded filtering effects. The filter layer 110 may also be provided in the form in which a plurality of filters formed of fiber materials that are coupled together by an adhesive or an arbitrary coupling means are laminated as necessary.

Meanwhile, a separate strap 130 may be coupled to the filter structure 100, and the user may wear the mask 1 by hanging the strap 130 on his or her ear.

The inner shell 200 may be provided at an inner side of the filter structure 100 so as to maintain the overall shape of the mask 1. Hereinafter, a specific configuration of the inner shell 200 provided in the mask 1 according to the embodiment of the present disclosure will be described with further reference to FIGS. 3 to 5.

Figure 3:
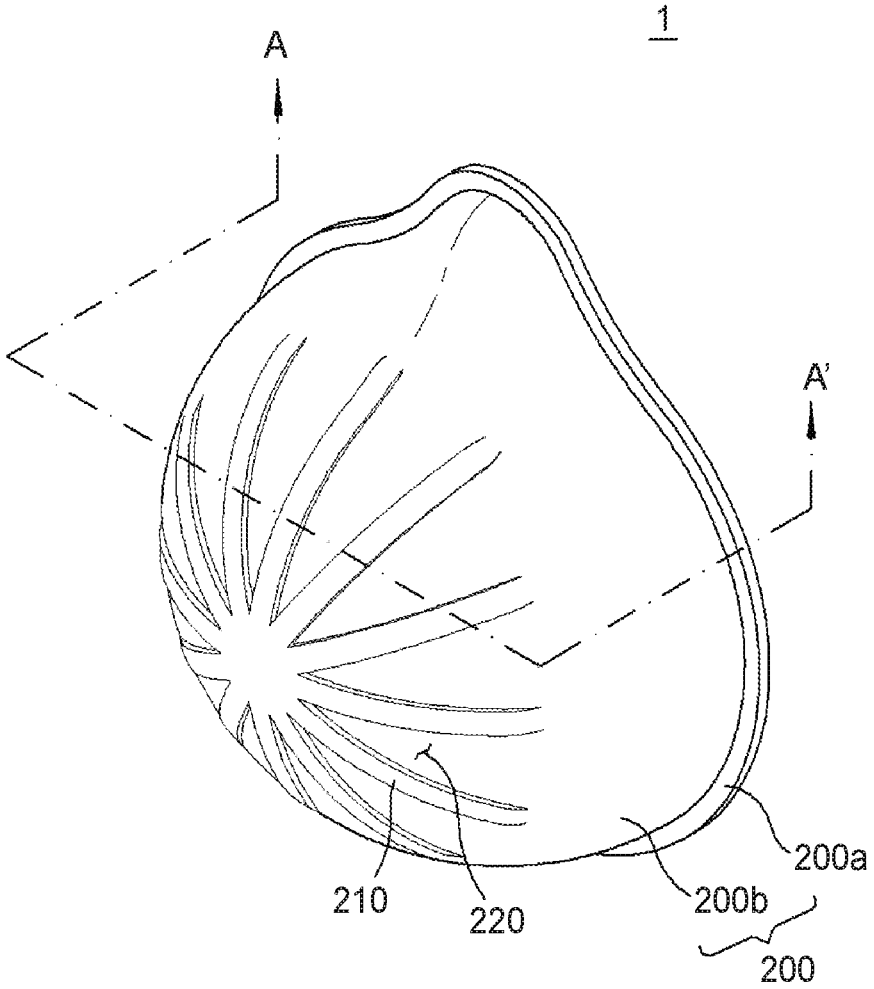
FIG. 3 is a perspective view of an inner shell provided in the mask according to the embodiment of the present disclosure.
Figure 4:
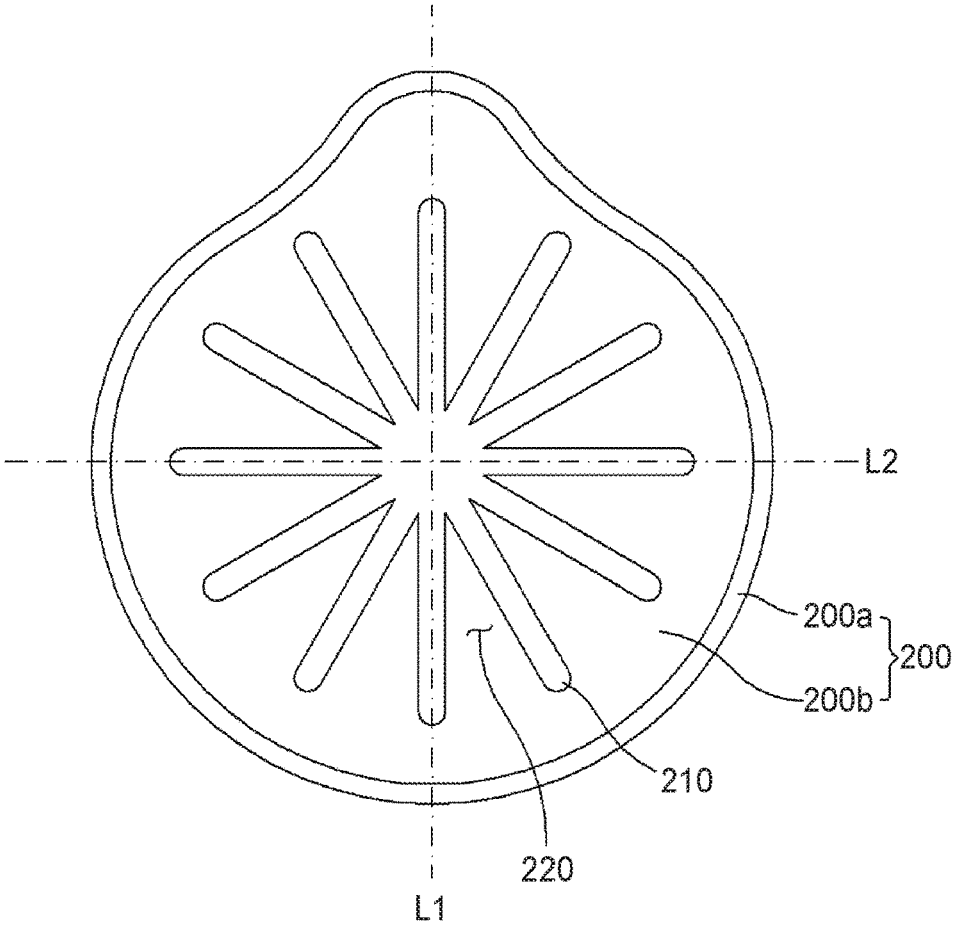
FIG. 4 is a plan view of the inner shell illustrated in FIG. 3.
Figure 5:
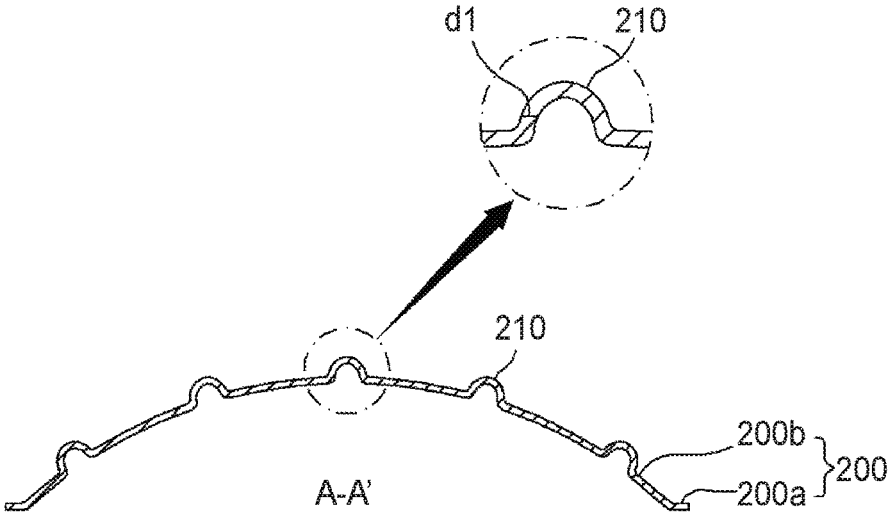
FIG. 5 is a cross-sectional view taken along line A-A' in FIG. 3.

FIG. 3 is a perspective view of an inner shell provided in the mask according to the embodiment of the present disclosure, FIG. 4 is a plan view of the inner shell illustrated in FIG. 3, and FIG. 5 is a cross-sectional view taken along line A-A' in FIG. 3. Further referring to FIGS. 3 to 5, the inner shell 200, which is a member provided for maintaining the shape of the mask 1, may be coupled to an inner surface of the filter structure 100. Here, the coupling may be performed by the circumferential part 200*a* of the inner shell 200 being heat-welded or ultrasonic-welded to an inner surface of the circumferential part 100*a* of the filter structure 100, instead of a curved part 200*b* of the inner shell 200 and a central part of the filter structure 100 being adhered to each other.

The inner shell 200 may be manufactured by hot-pressing a sheet member formed of a porous material and may include the circumferential part 200*a* forming an edge, the curved part 200*b* formed in an arch shape at an inner side of the circumferential part 200*a*, and a plurality of ribs 210 formed to radially protrude from a peak area of the curved part 200*b* toward the circumferential part 200*a*. At this time, when the inner shell 200 is manufactured by hot-pressing a sheet member, the circumferential part 200*a*, the curved part 200*b*, and the ribs 210 may be integrally formed. For example, the shapes of the curved part 200*b* and the ribs 210 may be imprinted on the inner shell 200 while the cup-shaped inner shell 200 is manufactured by hot-pressing the sheet member formed of a porous material. Here, the peak area refers to the highest point of the curved part 200*b* when the circumferential part 200*a* of the mask 1 is placed in a state in which the circumferential part 200*a* is in contact with a flat surface.

The sheet member may be provided with non-woven fabric formed of a porous material. For example, the non-woven fabric may be formed of polyester short fibers.

The circumferential part 200*a* may define the edge of the inner shell 200, and a face adhesion part 300 adhered to a user's face may be coupled to the circumferential part 200*a*. The face adhesion part 300 may be manufactured using a fiber material having ductility, and by the face adhesion part 300 being coupled to the circumferential part 200*a*, wearability may be improved when the user wears the mask 1.

The curved part 200*b* may be formed in an arch shape at the inner side of the circumferential part 200*a*, and the plurality of ribs 210 may be formed at the curved part 200*b*. Here, the ribs 210 may be formed by hot-pressing a sheet member.

The ribs 210 may be formed to increase stiffness and restoring force of the curved part 200*b*. In other words, by the ribs 210 being provided, the stiffness of the curved part 200*b* with respect to an external force may be increased, and even when the curved part 200*b* is deformed due to an external force, the curved part 200*b* may be easily restored to its original shape. Accordingly, the inner shell 200 and the mask 1 including the same may maintain its shape even when an external force is applied thereto and may be easily restored to its original shape even when the shape is deformed.

The ribs 210 may be radially formed from the peak area of the curved part 200*b* toward the circumferential part 200*a*, and by this, concave parts 220 may be formed between the plurality of ribs 210. The concave parts 220, which are spaces partitioned by the ribs 210, may be formed corresponding to the shapes of the ribs 210. For example, the concave parts 220 may be provided such that a width thereof progressively increases toward the circumferential part 200*a*.

A plurality of ribs 210 may be formed, and one end of each of the plurality of ribs 210 may be connected to ends of the other ribs 210 at the peak area.

The plurality of ribs 210 may be formed to be vertically symmetrical about a vertical central line L1 of the inner shell 200. Furthermore, the plurality of ribs 210 may be provided to be horizontally symmetrical about a horizontal central line L2 of the inner shell 200. Like the ribs 210, the concave parts 220 may be formed to be symmetrical about the vertical central line L1 or the horizontal central line L2 of the inner shell 200. However, the shapes of the ribs 210 and the concave parts 220 may be changed to various shapes as long as the shapes correspond to those capable of increasing the stiffness and restoring force of the curved part 200*b*.

The ribs 210 are formed by hot-pressing a sheet member. A thickness dl of the rib 210 may have various values according to a thickness and a degree of hot-pressing of the sheet member. For example, the thickness dl of the rib 210 may be in a range of 0.5 mm to 1.5 mm.

Accordingly, by forming the ribs 210 in the inner shell 200, the stiffness and restoring force of the mask 1 according to the embodiment of the present disclosure with respect to an external force may be improved.

Hereinafter, a mask 1 according to another embodiment of the present disclosure will be described with reference to FIGS. 6 to 11.

Figure 6:
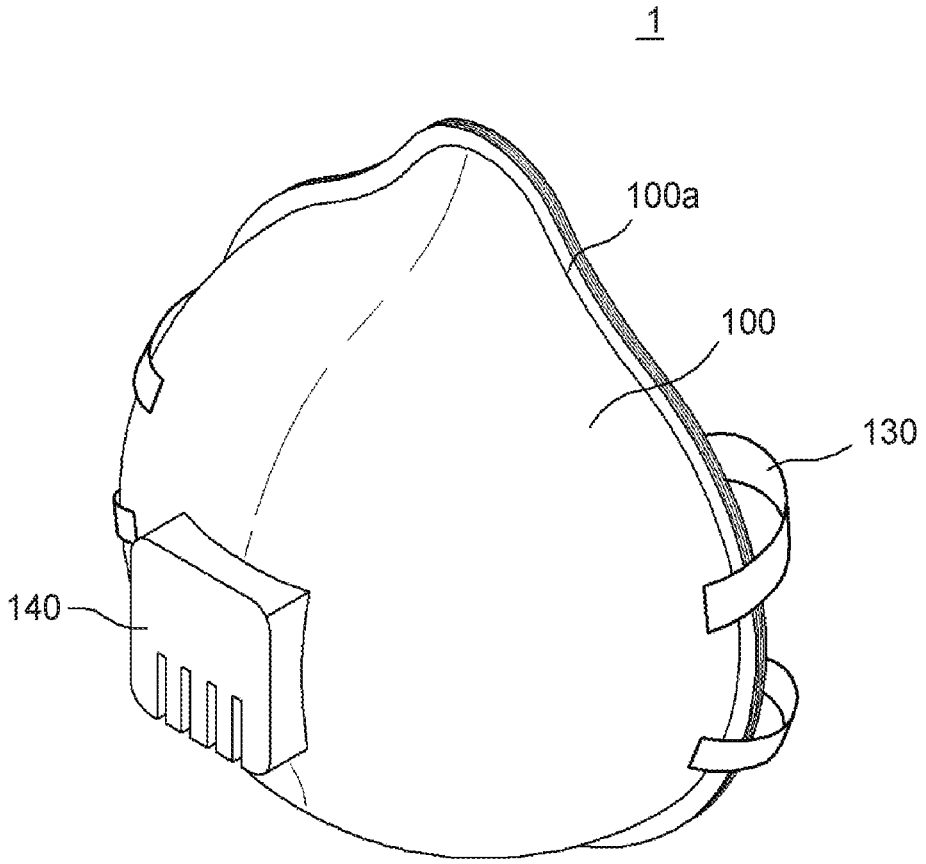
FIG. 6 is a perspective view of a mask according to another embodiment of the present disclosure.
Figure 7:
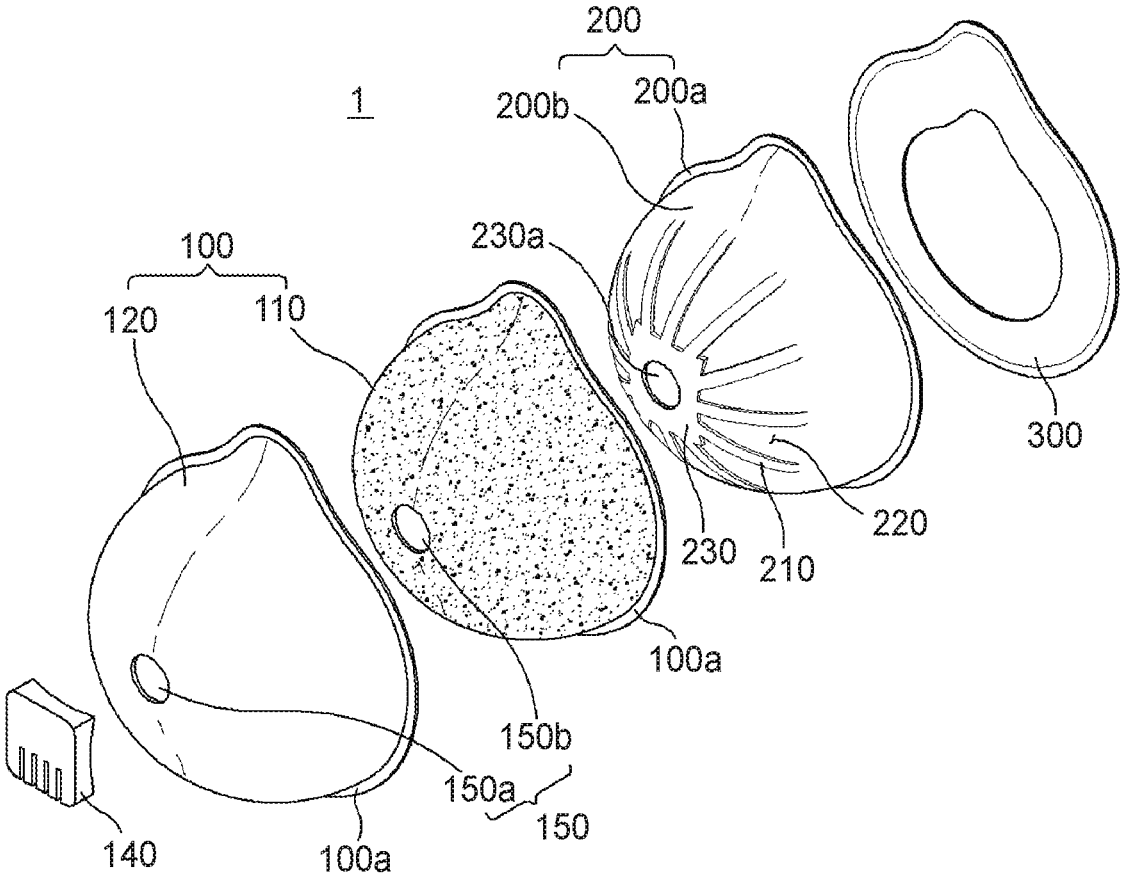
FIG. 7 is an exploded perspective view of the mask according to the other embodiment of the present disclosure.
Figure 8:
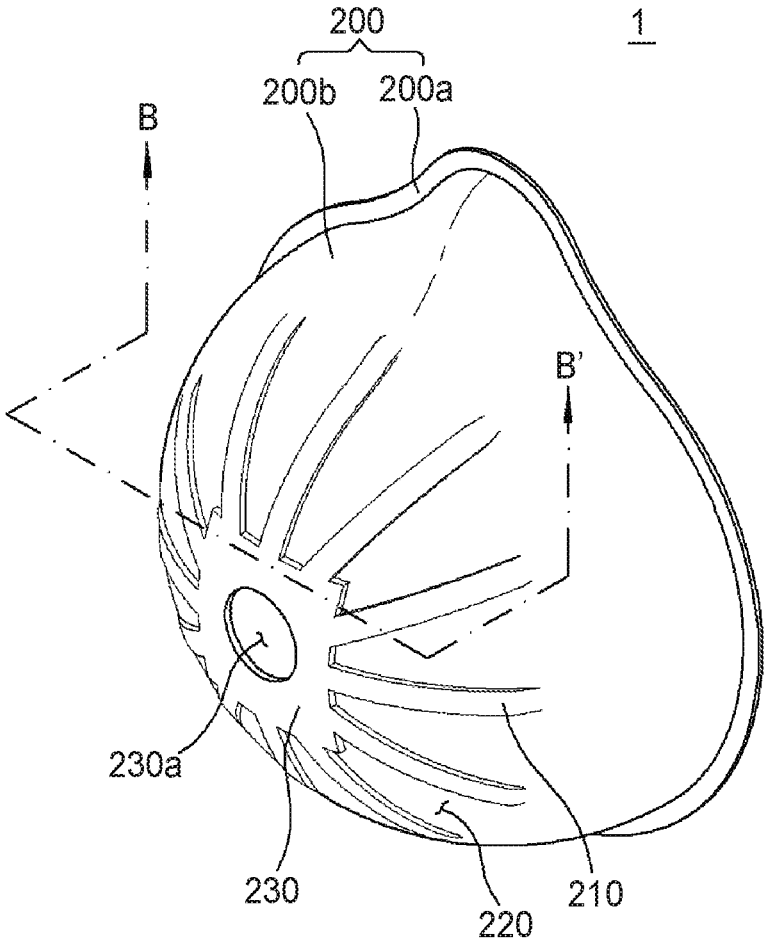
FIG. 8 is a perspective view of an inner shell provided in the mask according to the other embodiment of the present disclosure.
Figure 9:
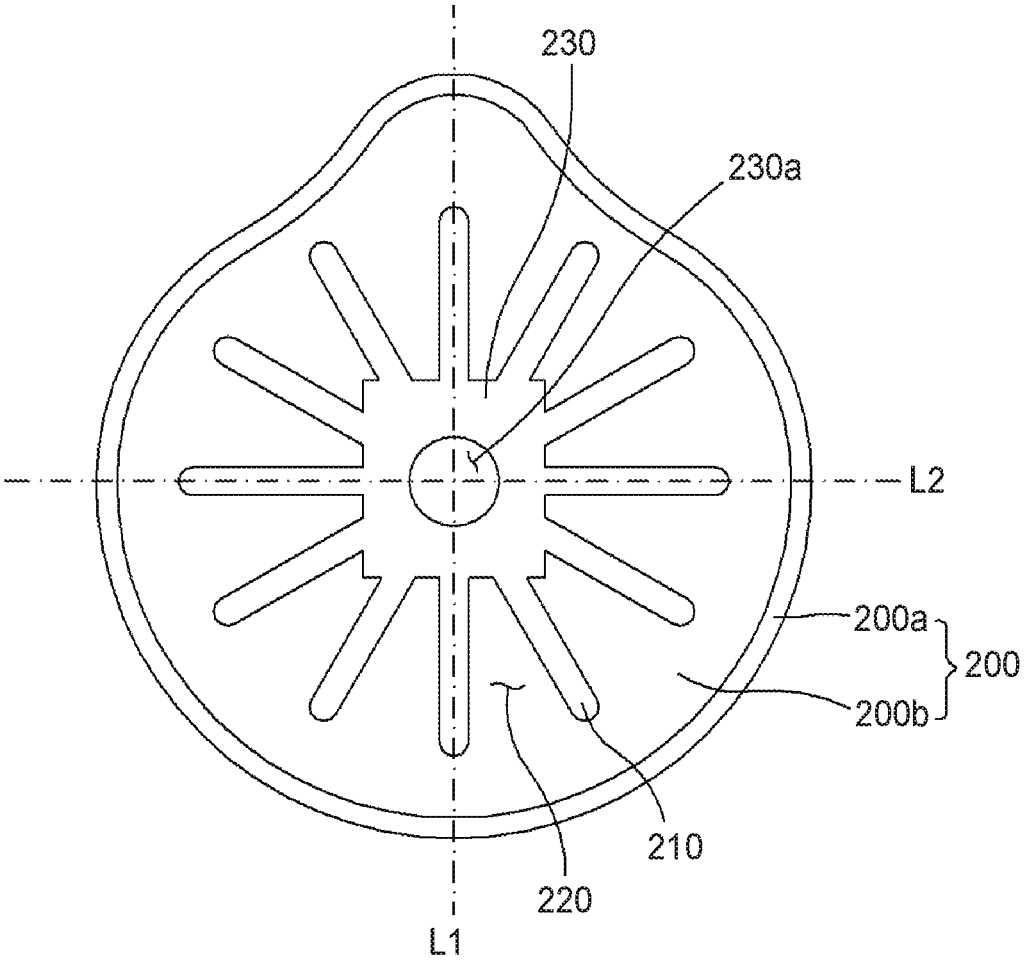
FIG. 9 is a plan view of the inner shell illustrated in FIG. 7.
Figure 10:
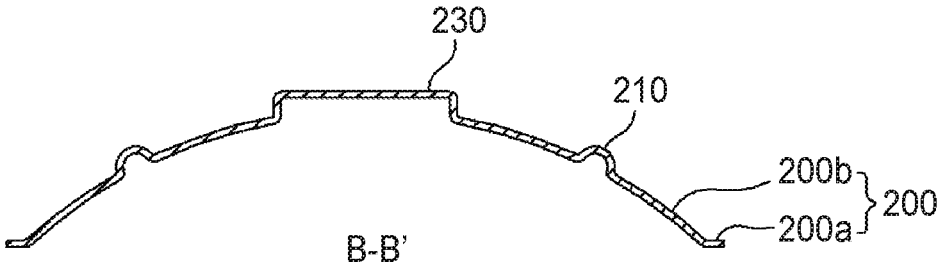
FIG. 10 is a cross-sectional view taken along line B-B' in FIG. 8.
Figure 11A:
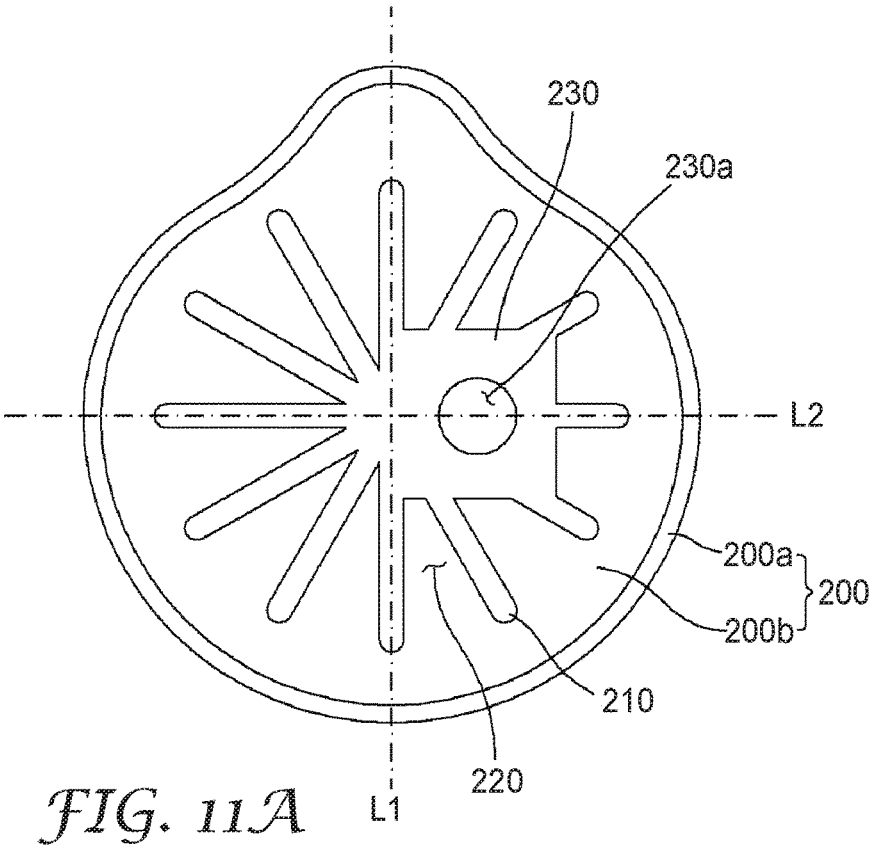
FIGS. 11A and 11B are plan views illustrating a modified example of a flat part formed in the mask according to the other embodiment of the present disclosure.
Figure 11B:
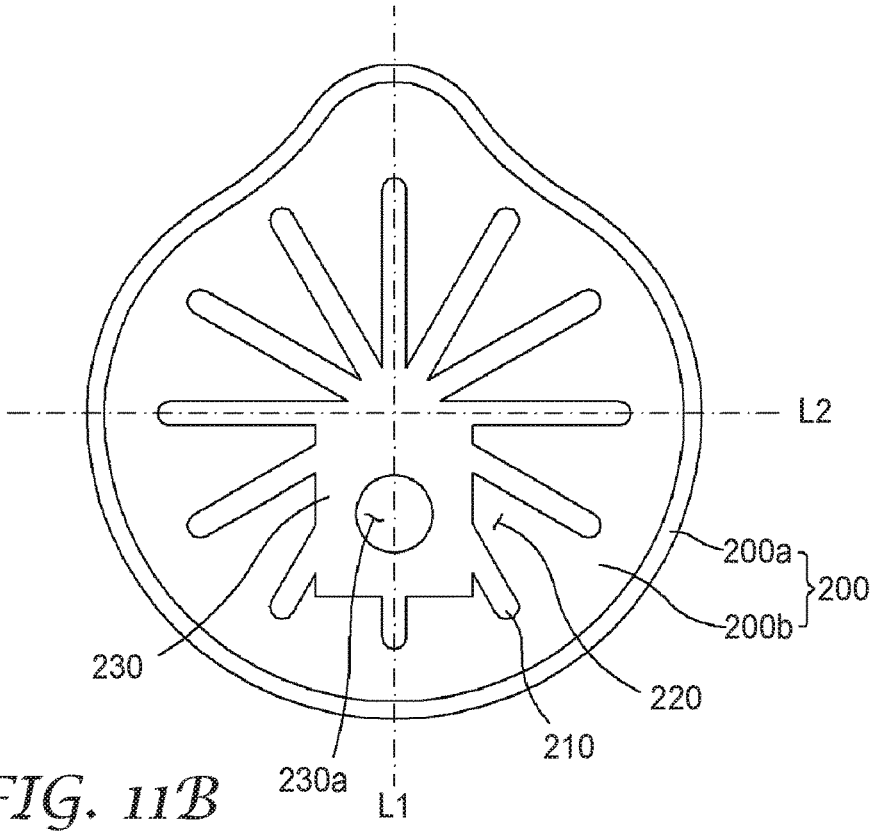

FIG. 6 is a perspective view of a mask according to another embodiment of the present disclosure, FIG. 7 is an exploded perspective view of the mask according to the other embodiment of the present disclosure, FIG. 8 is a perspective view of an inner shell provided in the mask according to the other embodiment of the present disclosure, FIG. 9 is a plan view of the inner shell illustrated in FIG. 7, FIG. 10 is a cross-sectional view taken along line B-B' in FIG. 8, and FIGS. 11A and 11B are plan views illustrating a modified example of a flat part formed in the mask according to the other embodiment of the present disclosure.

Referring to FIGS. 6 to 11, the mask 1 according to the other embodiment of the present disclosure may include an inner shell 200 provided to maintain the shape of the mask 1, a filter structure 100 coupled to an outer surface of the inner shell 200 and configured to perform an air filtering function, and a valve 140 coupled to the filter structure 100.

The filter structure 100, which is provided to remove impurities from air passing through the filter structure 100 and filter the air, may form an outer surface of the mask 1, and a circumferential part 100*a* of the filter structure 100 may be coupled to a circumferential part 200*a* of the inner shell 200 which will be described below. At this time, the circumferential part 100*a* of the filter structure 100 and the circumferential part 200*a* of the inner shell 200 may be coupled using various coupling methods, e.g., a heat welding or ultrasonic welding method.

The filter structure 100 may be manufactured in a multilayer shape in which a plurality of sheets are laminated. For example, the filter structure 100 may include a filter layer 110 provided for filtering air and a cover web 120 coupled to an outer surface of the filter layer 110 and configured to protect the filter layer 110 and prevent the filter layer 110 from being spaced apart from the inner shell 200. In the present embodiment, only the configuration in which the cover web 120 is only disposed at the outer surface of the filter layer 110 is illustrated. However, the cover web 120 may also be disposed at both an inner surface and the outer surface of the filter layer 110, and the cover web 120 may also be omitted in some cases.

The filter layer 110 may be provided as a filter formed of a fiber material that is capable of achieving typically demanded filtering effects. The filter layer 110 may also be provided in the form in which a plurality of filters formed of fiber materials that are coupled together by an adhesive or an arbitrary coupling means are laminated as necessary.

Meanwhile, the valve 140 may be provided at an outer surface of the filter structure 100. The valve 140, which is provided to assist easy breathing in a case in which the user breathes while wearing the mask 1, may be provided as a one-way valve that only allows air flow in one direction. For example, the valve 140 may be provided as a one-way valve that is closed when the user inhales and is opened when the user exhales. Therefore, when the user inhales, outside air may be filtered via the filter structure 100 and then be introduced to an inner side of the mask 1 without passing through the valve 140, and when the user exhales, air may be discharged to the outside via both the valve 140 and the filter structure 100.

Opening 150 may be formed at a portion at which the valve 140 of the filter structure 100 is coupled, and the openings 150 may communicate with a perforation 230*a* formed in the inner shell 200 which will be described below. The openings 150 formed in the filter structure 100 may include openings 150*a* and 150*b* formed in the cover web 120 and the filter layer 110, respectively. The openings 150 and the perforation 230*a* may form a path through which air may flow.

Meanwhile, a separate strap 130 may be coupled to the filter structure 100, and the user may wear the mask 1 by hanging the strap 130 on his or her ear.

The inner shell 200 may be provided at an inner side of the filter structure 100 so as to maintain the overall shape of the mask 1.

The inner shell 200, which is a member provided for maintaining the shape of the mask 1, may be coupled to an inner surface of the filter structure 100. Here, the inner shell 200 and the filter structure 100 may be coupled by the circumferential part 200*a* of the inner shell 200 being heat-welded or ultrasonic-welded to an inner surface of the circumferential part 100*a* of the filter structure 100, instead of a curved part 200*b* of the inner shell 200 and a central part of the filter structure 100 being adhered to each other.

The inner shell 200 may be manufactured by hot-pressing a sheet member formed of a porous material and may include the circumferential part 200*a* forming an edge, the curved part 200*b* formed in an arch shape at an inner side of the circumferential part 200*a*, and a plurality of ribs 210 formed at an outer surface of the curved part 200*b* and formed to radially protrude toward the circumferential part 200*a*. At this time, when the inner shell 200 is manufactured by hot-pressing a sheet member, the circumferential part 200*a*, the curved part 200*b*, and the ribs 210 may be integrally formed. For example, the shapes of the curved part 200*b* and the ribs 210 may be imprinted on the inner shell 200 while the cup-shaped inner shell 200 is manufactured by hot-pressing the sheet member formed of a porous material.

The sheet member may be provided with non-woven fabric formed of a porous material. For example, the non-woven fabric may be formed of polyester short fibers.

The circumferential part 200*a* may define the edge of the inner shell 200, and a face adhesion part 300 adhered to a user's face may be coupled to the circumferential part 200*a*. The face adhesion part 300 may be manufactured using a fiber material having ductility, and by the face adhesion part 300 being coupled to the circumferential part 200*a*, wearability may be improved when the user wears the mask 1.

The curved part 200*b* may be formed in an arch shape at the inner side of the circumferential part 200*a*, and a flat part 230 and the plurality of ribs 210 may be formed at the outer surface of the curved part 200*b*. Here, the flat part 230 and the ribs 210 may be formed by hot-pressing a sheet member.

The flat part 230 may be formed at a position corresponding to the valve 140 coupled to the filter structure 100. Therefore, the position at which the flat part 230 is formed may be changed to various positions corresponding to the position at which the valve 140 is provided. Also, the shape of the flat part 230 and the shape of the valve 140 may correspond to each other. For example, when the valve 140 is formed at a central part of the filter structure 100, the flat part 230 may be formed at a peak area of the curved part 200*b* (see FIG. 9), and when the valve 140 is formed to be leaned toward one side from the central part of the filter structure 100, corresponding thereto, the flat part 230 may also be formed to be leaned toward one side from a vertical central line L1 of the inner shell 200 (see FIG. 11A) or formed to be leaned toward one side from a horizontal central line L2 (see FIG. 11B). When the flat part 230 is present, the coupling of the valve 140 may be facilitated during manufacture of the mask. The perforation 230*a* may be formed in the flat part 230. The perforation 230*a* is provided so that air is easily discharged to the outside when the user exhales. Air discharged by the user may be discharged to the outside by sequentially passing through the perforation 230*a* of the inner shell 200, the openings 150 of the filter structure 100, and the valve 140.

To facilitate the arrangement of the valve 140, the flat part 230 may be formed to have a greater area than an area in which the valve 140 and the filter structure 100 come into contact.

The ribs 210 may be formed to increase stiffness and restoring force of the curved part 200*b*. In other words, by the ribs 210 being provided, the stiffness of the curved part 200*b* with respect to an external force may be increased, and even when the curved part 200*b* is deformed due to an external force, the curved part 200*b* may be easily restored to its original shape.

The ribs 210 may be radially formed from an edge of the flat part 230 toward the circumferential part 200*a*, and by this, concave parts 220 may be formed between the ribs 210. The concave parts 220, which are spaces partitioned by the ribs 210, may be formed corresponding to the shapes of the ribs 210. For example, the concave parts 220 may be provided such that a width thereof progressively increases toward the circumferential part 200*a*. A plurality of ribs 210 may be formed, and the plurality of ribs 210 may be formed to be vertically symmetrical about a vertical central line L1 of the inner shell 200. Furthermore, the plurality of ribs 210 may be provided to be horizontally symmetrical about a horizontal central line L2 of the inner shell 200. Like the ribs 210, the concave parts 220 may be formed to be symmetrical about the vertical central line L1 or the horizontal central line L2 of the inner shell 200. However, the shapes of the ribs 210 and the concave parts 220 may be changed to various shapes as long as the shapes correspond to those capable of increasing the stiffness and restoring force of the curved part 200*b*.

The ribs 210 are formed by hot-pressing a sheet member. A thickness dl of the rib 210 may have various values according to a thickness and a degree of hot-pressing of the sheet member. For example, the thickness dl of the rib 210 may be in a range of 7 mm to 11 mm.

Accordingly, by forming the ribs 210 in the inner shell 200, the stiffness and restoring force of the mask 1 according to the embodiment of the present disclosure with respect to an external force may be improved.

The following are lists of embodiments of the present disclosure.

Article 1 is an inner shell including a circumferential part forming an edge, a curved part formed in an arch shape at an inner side of the circumferential part, and a plurality of ribs formed to radially protrude from a peak area of the curved part toward the circumferential part, wherein the circumferential part, the curved part, and the ribs are integrally formed as a sheet member formed of a porous material.

Article 2 is the inner shell in which one end of each of the plurality of ribs is formed to come into contact with ends of the other ribs at an inner portion of the peak area.

Article 3 is the inner shell in which the plurality of ribs are formed such that the ribs formed at a left side and the ribs formed at a right side are symmetrical with respect to a vertical central line of the inner shell.

Article 4 is the inner shell in which the plurality of ribs are formed such that the ribs formed at an upper side and the ribs formed at a lower side are symmetrical with respect to a horizontal central line of the inner shell.

Article 5 is an inner shell including a circumferential part forming an edge, a curved part formed in an arch shape at an inner side of the circumferential part and having a flat part formed at an outer surface, and a plurality of ribs formed to radially protrude from an edge of the flat part toward the circumferential part, wherein the circumferential part, the curved part, and the ribs are integrally formed as a sheet member formed of a porous material.

Article 6 is the inner shell in which the flat part is formed at a peak area of the curved part.

Article 7 is the inner shell in which the flat part is formed to be leaned toward one side from a horizontal central line of the inner shell or from a vertical central line of the inner shell.

Article 8 is the inner shell in which a perforation is formed in the flat part.

Article 9 is the inner shell in which the circumferential part, the curved part, and the ribs are formed by hot-pressing the sheet member.

Article 10 is the inner shell in which concave parts are formed between the plurality of ribs, and the concave parts are provided such that a width thereof progressively increases toward the circumferential part.

Article 11 is the inner shell in which the sheet member is provided with non-woven fabric.

Article 12 is the inner shell in which the non-woven fabric is formed of polyester short fibers.

Article 13 is a mask including an inner shell of Articles 1 to 12 and a filter structure coupled to an outer surface of the inner shell.

Article 14 is a mask including an inner shell of Articles 5 to 8, a filter structure coupled to an outer surface of the inner shell, and a valve coupled to the filter structure, wherein the flat part is formed at a position corresponding to the valve.

Article 15 is the mask in which the flat part is formed to have a greater area than an area in which the valve and the filter structure come into contact.

While the inner shell and mask including the same of the present disclosure have been described with reference to specific embodiments thereof, the embodiments are merely illustrative. The present disclosure is not limited thereto and should be interpreted as having the widest possible scope according to the fundamental idea disclosed herein. Those of ordinary skill in the art may combine/substitute the embodiments disclosed herein and practice the embodiments in patterns not described herein, and such patterns are also within the scope of the present disclosure. In addition, those of ordinary skill in the art may easily change or modify the embodiments disclosed herein on the basis of the present specification, and it is apparent that such changes or modifications also belong to the scope of the present disclosure.

What is claimed is:

1. An inner shell, which is provided to maintain a shape of a mask and formed in a cup shape, the inner shell comprising:

a circumferential part forming an edge;

a curved part formed in an arch shape from an inner side of the circumferential part; and a plurality of ribs formed to radially protrude from a peak area of the curved part toward the circumferential part, wherein the circumferential part, the curved part, and the ribs are integrally formed as a sheet member formed of a porous material, and wherein one end of each of the plurality of ribs is formed to come into contact with ends of the other ribs at an inner portion of the peak area.

2. The inner shell of claim 1, wherein the plurality of ribs are formed such that the ribs formed at a left side and the ribs formed at a right side are symmetrical with respect to a vertical central line of the inner shell.

3. The inner shell of claim 1, wherein the plurality of ribs are formed such that the ribs formed at an upper side and the ribs formed at a lower side are symmetrical with respect to a horizontal central line of the inner shell.

4. The inner shell of claim 1, wherein the circumferential part, the curved part, and the ribs are formed by hot-pressing the sheet member.

5. The inner shell of claim 1, wherein:

concave parts are formed between the plurality of ribs; and the concave parts are provided such that a width thereof progressively increases toward the circumferential part.

6. The inner shell of claim 1, wherein the sheet member comprises a non-woven fabric.

7. The inner shell of claim 6, wherein the non-woven fabric is formed of polyester short fibers.

8. The inner shell of claim 1, wherein a thickness of each rib is in a range of 0.5 mm to 1.5 mm.

9. A mask comprising:

an inner shell of claim 1; and a filter structure coupled to an outer surface of the inner shell.

10. The mask of claim 9, further comprising a strap coupled to the filter structure.

11. The mask of claim 9, wherein a circumferential part of the filter structure is coupled to the circumferential part of the inner shell.

12. The mask of claim 11, wherein the circumferential part of the filter structure is heat welded or ultrasonically welded to the circumferential part of the inner shell.

13. The mask of claim 9, wherein the filter structure comprises a filter layer and a cover web coupled to an outer surface of the filter layer.

14. The mask of claim 13, wherein the cover web is further disposed on an inner surface of the filter layer.

15. The mask of claim 9, further comprising a face adhesion part coupled to the circumferential part of the inner shell, wherein the face adhesion part is adapted to adhere to a user's face.

16. The mask of claim 9, wherein the plurality of ribs of the inner shell are formed such that the ribs formed at a left side and the ribs formed at a right side are symmetrical with respect to a vertical central line of the inner shell.

17. The mask of claim 9, wherein the plurality of ribs of the inner shell are formed such that the ribs formed at an upper side and the ribs formed at a lower side are symmetrical with respect to a horizontal central line of the inner shell.

18. The mask of claim 9, wherein the circumferential part, the curved part, and the ribs of the inner shell are formed by hot-pressing the sheet member.

19. The mask of claim 9, wherein:

concave parts are formed between the plurality of ribs of the inner shell; and the concave parts are provided such that a width thereof progressively increases toward the circumferential part of the inner shell.

20. The mask of claim 9, wherein the sheet member of the inner shell comprises a non-woven fabric.

* * * * *